US005149911A

United States Patent [19]

Ringbloom et al.

[11] Patent Number: 5,149,911

[45] Date of Patent: Sep. 22, 1992

[54] FLEXIBLE SHEET EXPLOSIVE

[75] Inventors: Vernon D. Ringbloom, West Friendship; Matthew O. Savage, Woodbine, both of Md.

[73] Assignee: The United States of America as represented by the Secretary of the Navy, Washington, D.C.

[21] Appl. No.: 654,429

[22] Filed: Feb. 6, 1991

[51] Int. Cl.[5] ..... F42D 3/00; F42D 5/00

[52] U.S. Cl. ..... 102/302; 102/312; 102/313; 102/303

[58] Field of Search ..... 102/302, 303, 312, 313

[56] References Cited

U.S. PATENT DOCUMENTS 3,801,416 4/1974 Gulbierz ..... 102/302 X
3,814,016 6/1974 Leach et al. ..... 102/302 X
4,198,454 4/1980 Norton ..... 102/303 X
4,589,341 5/1986 Clark et al. ..... 102/303
4,643,119 2/1987 Langston et al. ..... 102/303 X
4,782,735 11/1988 Mui et al. ..... 102/303 X
4,905,601 3/1990 Gabriel et al. ..... 102/303 X
5,003,880 4/1991 Gut et al. ..... 102/313 X

*Primary Examiner*—Peter A. Nelson
*Attorney, Agent, or Firm*—Kenneth E. Walden

[57] ABSTRACT

An explosive device and process of using same is provided to exert a desired force on an object without exposure to the flame heat generated upon detonation of explosive charge sandwiched between protective layers of a protective casing. One of the layers is of a thickness sufficient to absorb substantially all of the explosive released thermal energy but sufficiently thin to transfer the kinetic energy associated with the desired force for cutting and/or deformation of the object.

16 Claims, 2 Drawing Sheets

FLEXIBLE SHEET EXPLOSIVE

BACKGROUND OF THE INVENTION

1. Field of the Invention

The invention relates in general to a flexible sheet explosive and, more particularly, to a thermally stable sheet explosive which is relatively insensitive to impact and shock and which can be used to cut and/or deform an object without exposing the object to excessive heat or detonation pulse.

2. Description of Related Art

Sheet explosives have been used extensively in civilian applications in demolition, industrial, and experimental work. The sheet explosives consist of coarse grade of pentaerythritol tetranitrate (PETN) and an energetic binder containing nitrocellulose and a plasticizer. The explosive output of the sheet explosive is controlled to a certain extent by varying both the explosive solids loading of PETN and by adding more powerful explosives, such as cyclotrimethylene trinitramine (RDX) and cyclohexamethylene hexanitramine (HMX), to the PETN-based formulation. These sheet explosives are considered unsatisfactory for use in some applications because they lack both thermal stability and impact insensitivity, since PETN is inherently sensitive to initiation by heat, impact, and shock. Attempts to develop a thermally stable and shock insensitive replacement for PETN have thus far been unsuccessful.

Through extensive testing, it has been found that current heat-resistance explosives, such as HMX, hexanitrostilbene, nonanitroterphenyl, bispicrylaminodinitropyridine, and octanitroterphenyl, simply lack the low critical thickness required to be used in detonable thin sections when combined with an appropriate amount of inert elastomeric binder to obtain a flexible sheet. Approximately 40% (60% explosives solids loading) of inert elastomeric binder is required to form a flexible sheet with the above-described explosives, but in the case of HMX, in some thicknesses, at least 90% solids loading is required to obtain a detonable material. Formulations with 90% solids are mechanically rigid in nature and tend to have very high detonation pressures. It appears that the critical thickness criteria can only be achieved by increasing the explosives solids loading at the expense of decreased flexibility and low detonation pressures.

It is, therefore, desirable to have a flexible sheet explosive that is thermally stable at temperatures approaching 150° C. and which is relatively insensitive to impact and shock.

Additionally, it is desirable to provide a flexible sheet explosive having a selectively adjustable explosive output.

It is also desirable to have a flexible sheet explosive which solves the problem of flexibility and excessive detonation pressures.

SUMMARY OF THE INVENTION

In accordance with the present invention, a thermally stable and impact and shock insensitive, flexible sheet explosive is provided for cutting and/or deforming an object without subjecting the object to excessive heat. The sheet explosive comprises an explosive charge sandwiched between two layers of an elastomeric material, such as polyurethane, one of the layers of elastomer being of a thickness sufficient to restrict heat flow by absorbing thermal energy released by detonation of the explosive charge while transmitting to an adjacent object a sufficient amount of the kinetic energy released by the explosion without attendant excessive heat from the explosive flame.

BRIEF DESCRIPTION OF THE DRAWING

Various other objects, features, and attendant advantages of the present invention will be more fully appreciated as the same becomes better understood when considered in conjunction with the accompanying drawings in which like reference characters designate the same or similar parts throughout the several views, and wherein:

Referring to FIG. 1, the explosive device according to one embodiment of the present invention comprises an explosive charge in the form of a thin layer of high explosive material 1 embedded in a protective casing 2 made of an elastomeric material. The thin explosive layer may be granular in nature, a viscous base, or it may be made of several rigid or semi-rigid tiles of pressed or cast explosive, as illustrated in FIGS. 1 and 2. A channel 4, preferably round in shape, is formed in the top layer of the elastomeric casing material for holding a blasting cap 5. A fuse 6 may comprise an electrical connection or a blank fuse to effect detonation of the blasting cap 5.

The flexible elastomeric casing is preferably formed of natural rubber; homopolymers of polyethylene, polypropylene, neoprene, polybutadiene, and polyisoprene; homo- and copolymers of epichlorohydrin; copolymers such as styrene-butadiene rubber, butylrubber, and nitrile rubber; copolymers of ethylene-propene; fluoroelastomers; polyacrylates; polycondensation products such as polyurethane, silicon rubber, and polysulfide rubbers; and halogen-substituted rubbers. The polyethylene and polypropylene homopolymers produce nontoxic reaction products. Therefore they are preferred for applications where personnel may be exposed to the reaction products.

Generally, any type of high explosive can be used in the present invention providing it is capable of detonation when in the form of a thin layer. Preferred explosives are HMX-based plastic binder explosives and the nitramine and nitrate esters family of explosives. The explosive layer 1 can include a high explosive, a heat-resistant explosive filler, and a conventional explosive binder. Also, explosives that have not been used in sheet explosives due to their friability can be used in the present invention because the layers of elastomer maintain the explosive in position even if it is fractured when bent. For example, brittle pentolite explosive which normally fractures when bent is suitable for use in the present invention because the fractured pieces are held in position by the encapsulating layers of elastomer.

The flexible elastomeric casing 2 provides the functions of mechanical support for the high explosive layer 1 and a thermal insulating layer to restrict the flow of heat into the explosive layer, thereby increasing both fast and slow cook-off performance. In addition, the flexible elastomeric casing 2, being resilient and shock-absorbent in nature, decreases the susceptibility to initiation of detonation by impact or shock.

Figure 1:
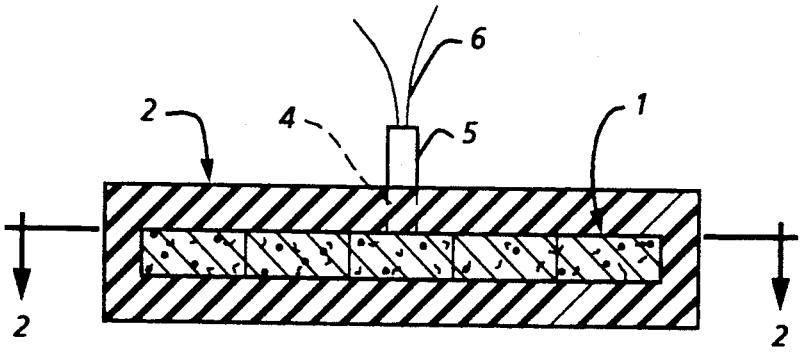
FIG. 1 is a side view in cross-section of the explosive device of the present invention, illustrating in particular the encapsulation of the thin explosive layer.
Figure 2:
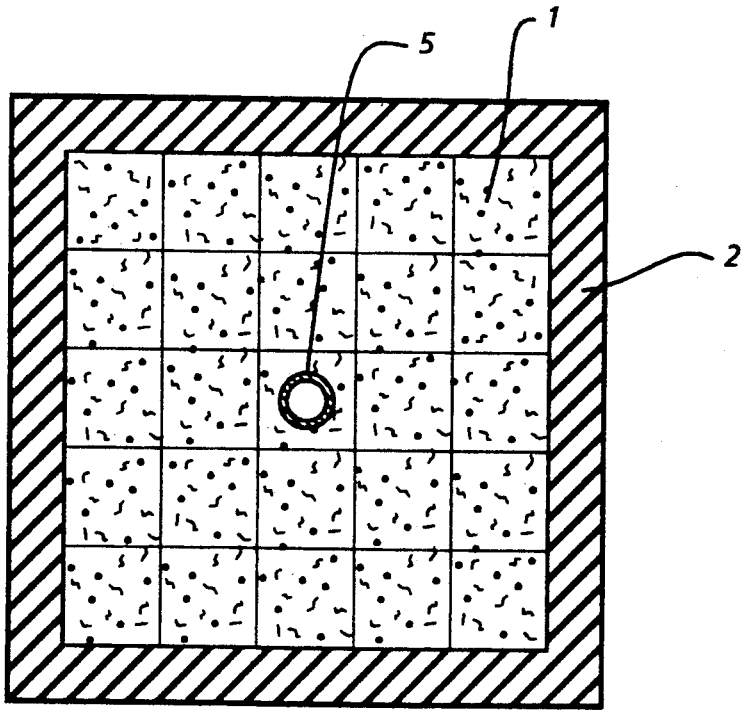
FIG. 2 is a top view taken along line 2—2 of FIG. 1, illustrating the arrangement of the explosive tile.
Figure 3:
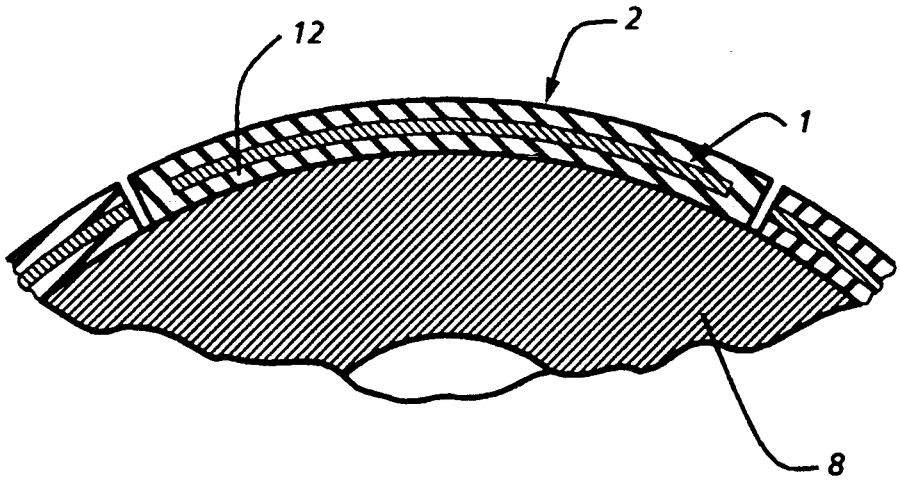
FIG. 3 is a partial side section view of the explosive device positioned on an object to be deformed.

In certain embodiments as depicted in FIG. 3, the encased sheet explosive is bent to the external curvature of a solid object 8 on which it is positioned. According to other embodiments, the sheet explosive is sufficiently flexible to be bent around a radius equal to its thickness. Preferably, the elastomeric material of casing 2 is cast about the layer 1 of high explosive. In a preferred embodiment. the thin layer of explosive is from about 1–6 mm, more preferably 1–5 mm thick, and the layers of elastomeric materials are each from about 2–12 mm thick, more preferably, from about 5–6 mm thick. In a most preferred embodiment, the thickness of the elastomeric layer to be placed in contact with the object 8 to be cut or deformed is from about 6–8 mm thick, and the elastomeric layer on the other side of the explosive is from about 2–3 mm thick.

Although the elastomeric material of casing 2 can be used in solid form, foamed elastomers can also be used. These foamed elastomeric layers are particularly suitable when attenuating of the kinetic energy of the explosive becomes more critical. Preferred foamed elastomers include polystyrene, polyurethane, and polyethylene. Thickness ranges for the porous elastomers is approximately the same as the thickness for solid polymers.

Figure 4:
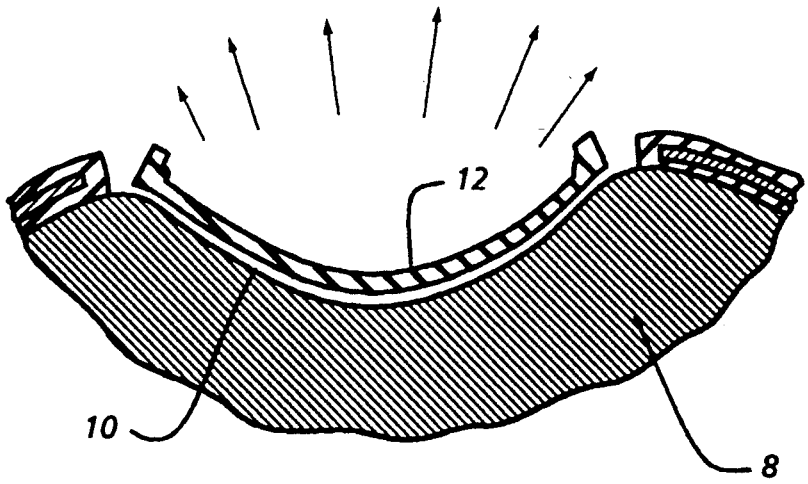
FIG. 4 illustrates the disintegration of the explosive device of the present invention while positioned on the object being deformed.

In addition to the thermal energy absorbing function, the layer of elastomeric material between the explosive charge 1 and the object to be cut or deformed attenuates the force of the explosion. The thickness of the elastomeric layer between the object to be cut or deformed and the explosive charge layer is selectively adjusted to tailor the explosive force for a particular application. For example, where the object to be deformed is relatively thin, it may be desirable to use a relatively thick elastomeric layer between the explosive and the object to attenuate the explosion. For thicker objects as shown in FIG. 3 for example, thinner elastomeric layers can be used where greater explosive forces are desired.

Where the flexible sheet explosive is to exert an effective force on the object for cutting and/or deforming thereof without subjecting the object to excessive heat, such as the explosive flame, one of the layer portions 12 of the elastomeric material placed adjacent the object is of a thickness sufficient to absorb released thermal energy from the detonation of the explosive charge so as to minimize exposure of the object to the explosive flame. The disintegration of such a flexible sheet explosive according to the present invention is shown in FIG. 4. The object 8 is accordingly deformed at 10 by the effective force exerted thereon as the sheet explosive detonates.

Preferably, the elastomeric sheet is of a thickness sufficient to absorb enough of the energy of the explosive charge to prevent the explosive flame from contacting the object. Although the exact mechanism of the energy absorption of the flame is not entirely understood, it is believed that absorption of the explosive flame energy results in scission of the polymer bonds and oxidation of the polymeric chains of the elastomeric material. It has been found that an elastomeric layer can absorb sufficient released thermal energy to prevent the explosive flame from contacting and/or deleteriously affecting an object against which the elastomeric layer is in contact. It is also important that the layer of elastomer be sufficiently thin to transmit explosive kinetic energy to effect the desired cutting and/or deformation of an object.

The thickness of the layers of elastomeric material depend, of course, on the type and amount of high explosive used in the explosive charge, and the particular elastomeric material used. For any given amount and type of thin explosive layer, the thickness of the elastomeric layer can be determined readily by routine experimentation, i.e., by preparing a series of samples with varied thicknesses, placing them against an object to be deformed with a thermocouple at the surface of the object between the flexible explosive device and the object, and detonating same while measuring the temperature

DESCRIPTION OF THE PREFERRED EMBODIMENTS

In a preferred embodiment, a flexible explosive device was constructed with the explosive section being built from 25 preformed explosive tiles 1 measuring 1.0″×1.0″×0.2″ in thickness. A thermally stable HMX-based explosive bonded with polyisobutylene was used in fabricating the explosive sheet. The explosive section was encased in an inert polyurethane elastomeric material such that 0.25″ of casing material covered the explosive sheet on all sides. The polyurethane elastomer used consisted of a linear hydroxyl-terminated polybutadiene monomer crosslinked with dimeryl diisocyanate. A round channel 4 was formed in the top layer of the casing for positioning a No. 12 engineer's special blasting cap 5 such that the output of the cap contacted the surface of the explosive sheet.

The flexible sheet explosive is placed against an aluminum witness plate 4″ in diameter and 2″ in thickness. The witness plate was placed on a solid base, i.e., an iron anvil. Upon detonation, the witness plate is deformed approximately 4 mm as a result of the explosion, and the elastomer absorbed substantially all of the explosive flame and a portion of the pressure pulse, and prevented the flame from deleteriously affecting the surface of the witness plate. The initiation of the blasting cap detonated the first explosive tile, which in turn detonated neighboring tiles, thereby transferring detonation energy radially outwardly throughout the entire explosive sheet. It was found that when subjected to detonation shock, the flexible elastomeric casing deforms, heats, and endothermically decomposes absorbing part of the shock and thermal energy. The casing material attenuated the detonation shock so that the peak detonation pressure of the shock wave is reduced and spread over a longer time period than if the flexible elastomeric layer were omitted.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. An explosive sheet device for exerting an effective force on an object positioned in operative relation thereto, comprising: explosive charge means for internally generating thermal and kinetic energy in response to detonation thereof and flexible protective means for rendering the explosive charge means insensitive to externally applied impact forces, including thermal insulating means supportingly spacing the explosive charge means from the object for restricting flow of the thermal energy released by said detonation, said thermal insulating means being formed by two energy absorbing layers between which the explosive charge means is sandwiched, one of said two layers being dimensioned to substantially absorb the thermal energy released while sufficiently transmitting the kinetic energy to the object to exert said effective force thereon.

2. The device as defined in claim 1 wherein said effective force is operative to cut the object.

3. The device as defined in claim 1 wherein said effective force is operative to cause deformation of the object.

4. The device as defined in claim 1 wherein said explosive charge means is a layer of explosive material having a thickness of approximately 1 to 6 mm.

5. The device as defined in claim 1 wherein said flexible protective means is made of elastomeric material.

6. The device as defined in claim 5 wherein the elastomeric material is selected from the group consisting of polycondensation products and natural and synthetic rubbers.

7. The device as defined in claim 1 further comprising a detonator positioned adjacent the explosive charge means.

8. The device as defined in claim 1 wherein the explosive charge means is a layer of high explosive formed into a continuous sheet.

9. The device as defined in claim 1 wherein the explosive charge means is a layer formed by a plurality of adjacent tiles of high explosives.

10. The device as defined in claim 1 wherein the explosive charge means is a layer of high explosives, a heat-resistant filler and a binder.

11. The device as defined in claim 5 wherein said elastomeric material is cast around said explosive charge means to form the two energy absorbing layers of the thermal insulating means.

12. The device as defined in claim 1 wherein the energy absorbing layers are made of polyurethane dimensioned in thickness approximately 6–8 mm and 2–3 mm, respectively, on opposite sides of the explosive charge means.

13. The device as defined in claim 5 wherein the elastomeric material of the energy absorbing layers is a foam.

14. A process of exerting an effective force on a solid object by detonation of an explosive charge to generate thermal and kinetic energy, including the steps of: positioning said explosive charge in operative relation to the object; selecting a flexible sheet material having energy absorbing properties dependent on thickness thereof; and separating the object from the positioned explosive charge with the sheet material of a thickness to substantially absorb the generated thermal energy while sufficiently transmitting the kinetic energy to exert said effective force on the object during said detonation of the explosive charge.

15. The process as defined in claim 14 wherein said effective force is operative to cut the object.

16. The process as defined in claim 14 wherein said effective force is operative to deform the object.

* * * * *